US005713731A

United States Patent [19]

Utter et al.

[11] Patent Number: 5,713,731

[45] Date of Patent: Feb. 3, 1998

[54] RADIAL COMPLIANCE MECHANISM FOR CO-ROTATING SCROLL APPARATUS

[75] Inventors: Robert E. Utter, Whitehouse; Chih M. Lin; Michael P. Mackelfresh, both of Tyler, all of Tex.

[73] Assignee: Alliance Compressors, Tyler, Tex.

[21] Appl. No.: 700,800

[22] Filed: Aug. 21, 1996

Related U.S. Application Data

[62] Division of Ser. No. 554,077, Nov. 6, 1995, Pat. No. 5,609,478.

[51] Int. Cl.[6] ..... F01C 1/04; F01C 21/04

[52] U.S. Cl. ..... 418/55.5; 418/55.6; 418/57

[58] Field of Search ..... 418/55.5, 55.6, 418/57

[56] References Cited

U.S. PATENT DOCUMENTS

| | | | |
|---|---|---|---|
| Re. 34,413 | 10/1993 | McCullough | 418/55.5 |
| 4,178,143 | 12/1979 | Thelen et al. | 418/57 |
| 4,575,318 | 3/1986 | Blain | 418/55.5 |
| 4,585,402 | 4/1986 | Morishita et al. | 418/55.5 |
| 4,585,403 | 4/1986 | Inaba et al. | 418/55.5 |
| 4,609,334 | 9/1986 | Muir et al. | 418/55.5 |
| 4,824,343 | 4/1989 | Nakamura et al. | 418/55.1 |
| 4,840,549 | 6/1989 | Morishita et al. | 418/55.5 |
| 4,846,639 | 7/1989 | Morishita et al. | 418/55.5 |
| 4,927,339 | 5/1990 | Riffe et al. | 418/55.5 |
| 4,934,910 | 6/1990 | Utter | 418/55.5 |
| 5,011,384 | 4/1991 | Grunwald et al. | 418/55.5 |
| 5,017,107 | 5/1991 | Fraser, Jr. et al. | 418/55.5 |
| 5,076,772 | 12/1991 | Fraser, Jr. et al. | 418/55.5 |
| 5,085,565 | 2/1992 | Barito | 418/55.4 |
| 5,101,644 | 4/1992 | Crum et al. | 62/498 |
| 5,108,274 | 4/1992 | Kakuda et al. | 418/55.1 |
| 5,111,712 | 5/1992 | Kassouf et al. | 74/570 |
| 5,129,798 | 7/1992 | Crum et al. | 418/55.4 |
| 5,174,739 | 12/1992 | Kim | 418/55.5 |
| 5,193,992 | 3/1993 | Terauchi | 418/55.5 |
| 5,197,868 | 3/1993 | Caillat et al. | 418/55.5 |
| 5,199,862 | 4/1993 | Kondo et al. | 418/57 |
| 5,242,282 | 9/1993 | Mitsunaga et al. | 418/55.5 |
| 5,328,342 | 7/1994 | Ishii et al. | 418/55.5 |
| 5,421,709 | 6/1995 | Hill et al. | 418/55.6 |
| 5,449,279 | 9/1995 | Hill et al. | 418/55.6 |
| 5,496,157 | 3/1996 | Shoulders et al. | 418/14 |

FOREIGN PATENT DOCUMENTS

| | | | |
|---|---|---|---|
| 0478795 A1 | 4/1992 | European Pat. Off. . | |
| 0678673 A1 | 10/1995 | European Pat. Off. . | |
| 4171290 | 6/1992 | Japan | 418/55.5 |
| 4-269389 | 9/1992 | Japan . | |
| WO 93/17222 | 9/1993 | WIPO . | |
| WO 95/08713 | 3/1995 | WIPO . | |

*Primary Examiner*—John J. Vrablik
*Attorney, Agent, or Firm*—Michael E. Martin

[57] ABSTRACT

A scroll type fluid handling apparatus, such as a refrigeration compressor, has co-rotating driver and idler scroll members supported for rotation about offset, generally parallel axes. The idler scroll member has a support shaft which is supported on the compressor housing by a pivot bushing having an eccentric pivot axis which permits radially compliant movement of the idler scroll along a line of action which is predetermined to provide a component of a resultant force acting between the scroll members which will urge the idler scroll wrap into engagement with the driver scroll wrap under a wide range of operating conditions to enhance the contact line seal between the scroll wraps. The idler scroll support shaft may have a bearing bore sleeved over a bearing surface on the pivot bushing and the pivot bushing supported on a stub shaft of the housing, or the idler scroll support shaft may be disposed in a bearing bore formed in the bushing which, in turn, is mounted for limited rotation in a bearing bore formed in the housing stub shaft part. Cooperating stop surfaces between the pivot bushing and the housing stub shaft limit the radial excursion of the idler scroll and its support shaft with respect to the driver scroll. The idler scroll support shaft may also be mounted in a bushing disposed in a channel or supported on an elongated trunnion which provides for linear translation of the bushing, the support shaft and the idler scroll along the line of action and responsive to the resultant force.

10 Claims, 6 Drawing Sheets

RADIAL COMPLIANCE MECHANISM FOR CO-ROTATING SCROLL APPARATUS

This application is a division of application Ser. No. 08/554,077, filed: Nov. 6, 1995, now U.S. Pat. No. 5,609,478.

FIELD OF THE INVENTION

The present invention pertains to a mechanism for permitting radially compliant movement of the idler scroll of a co-rotating scroll fluid handling apparatus.

BACKGROUND

Scroll apparatus for fluid compression or expansion are characterized by two opposed interfitting spiroidal wraps, typically generated as involute spiroids about respective axes. Each spiroidal wrap is mounted on an end plate and has a tip disposed in contact or near contact with the end plate of the other wrap and each wrap further has flank surfaces which adjoin the flank surfaces of the other wrap to form a plurality of moving fluid compression or expansion chambers.

In one relatively well developed configuration of scroll apparatus, one of the scrolls is fixed with respect to a support housing and the other scroll is connected to a drive shaft, in the case of a compressor, or a power output shaft in the case of an expander, and relatively complex linkage is provided for conversion of orbital motion of the movable scroll to rotary motion of the shaft. Such mechanism includes an eccentric driving member and coupling mechanism, such as an Oldham type coupling, to permit orbital motion of the movable scroll without allowing rotation of same with respect to the machine housing. Alternatively, one of the scroll members, commonly referred to as the idler scroll, may be connected to the driving or driven scroll member through an Oldham coupling and both members are rotated to provide coaction between the scroll wraps to develop the moving compression or expansion chambers. This type of scroll apparatus is typically referred to as a co-rotating or co-rotational type.

Co-rotating scroll expansion or compression apparatus is inherently less complicated, mechanically, generates less mechanical vibration and usually generates less noise than the so-called fixed scroll type apparatus. The latter two advantages of co-rotating scroll apparatus are particularly important in applications of scroll apparatus as compressors used in commercial as well as household vapor compression air conditioning and refrigeration systems.

A significant factor in providing an efficient and mechanically reliable scroll apparatus is the assurance of proper sealing engagement between the cooperating opposed scroll wraps to prevent unwanted fluid leakage from the expansion or compression chambers. Leakage may occur at the contact lines along the flank surfaces of the cooperating scrolls as well as at the axial side edges or tips of the scroll wraps if precise dimensioning and positioning of the wraps cannot be obtained and/or forces tending to separate the scroll flanks cannot be overcome due to deflection of the machine components and machining tolerances, for example. Although contact between the scroll flank surfaces of the respective scroll wraps is desired to minimize fluid leakage, the contact force should be limited so as to minimize wear between the scroll wraps. On the other hand, it is necessary in fluid handling apparatus wherein liquid slugs may be passed through the compression or expansion chambers from time to time to allow some momentary separation of the wraps to prevent mechanical damage to the scrolls. This is particularly important in compressors used in vapor compression refrigeration systems wherein a lubricating oil is injected into the moving chambers to aid in the sealing function, to reduce compression work and to provide a lubricant for the scroll wraps and other components in the system.

Radial compliance mechanisms have been developed for so-called fixed scroll type fluid handling apparatus to overcome the above-mentioned problems in providing adequate sealing while allowing movement of the scroll wraps relative to each other to handle fluid slugs and to reduce starting torque of machines, such as compressors. However, in co-rotational scroll type apparatus it has been determined that it is more desirable to provide for limited radial movement between the driving or driven scroll and the rotating idler scroll by permitting movement of the idler scroll center of rotation or central axis with respect to the axis of the driving or driven scroll. Providing a radial compliance mechanism which allows limited movement of the center axis of the idler scroll provides a mechanically simpler and more reliable apparatus than is possible by utilizing prior art radial compliance mechanisms connected to an orbiting type driving or driven scroll. It is to these ends that the present invention has been developed.

SUMMARY OF THE INVENTION

The present invention provides an improved radial compliance mechanism for scroll type fluid handling apparatus. In particular, the invention provides a radial compliance mechanism adapted for co-rotating scroll apparatus having a rotating driver or driven scroll and a co-rotating idler scroll. More particularly, the invention provides a radial compliance mechanism for a scroll compressor having co-rotational scroll elements.

In accordance with one important aspect of the invention, a radial compliance mechanism for a co-rotating scroll apparatus is provided wherein the idler scroll member is supported for limited movement of its center or axis of rotation substantially along a line of action chosen such that a force exists which urges the scroll wraps into sealing contact with each other and opposing a force tending to separate the wraps from engagement with each other along their cooperating flank surfaces.

In accordance with another important aspect of the invention, a radial compliance mechanism for a co-rotational scroll type fluid handling apparatus is provided wherein the idler scroll member is supported for movement of its support shaft along a line forming an angle relative to a line passing through the idler scroll rotation center and the driver or driven scroll rotation center such that a force acts in opposition to the force which tends to separate the scroll wraps from each other so that the wraps are forced into sealing contact with each other over a relatively wide range of operating conditions of the apparatus. Movement of the idler scroll and its support shaft is obtained along a line parallel to the aforementioned line of action or by pivotal movement of the support shaft center about a fixed point located such that a line through the fixed point and the idler scroll center forms a right angle at its intersection with the line of action.

The present invention contemplates the provision of one basic embodiment of a radial compliance mechanism for a co-rotating scroll fluid handling apparatus wherein the idler scroll support shaft is mounted on a bushing which is supported by the apparatus housing for pivotal movement between limit positions to adjust the position of the center of the idler scroll support shaft to provide for sealing contact between the scroll wraps, to accommodate liquid slugs trapped in the compression or expansion chambers and to minimize starting effort for such apparatus when operating as a compressor. Specific embodiments of the invention are provided wherein the idler scroll support shaft may be configured to be supported sleeved over the pivot bushing and supported thereby or mounted within a bearing bore formed in the pivot bushing. The pivot bushing has stop surfaces formed thereon cooperable with stop surfaces formed on a support shaft or bearing for the pivot bushing to limit the movement of the idler scroll center.

In accordance with another basic embodiment of the invention, a radial compliance mechanism is provided for a co-rotating scroll apparatus wherein the idler scroll support shaft is supported by a bushing member which is mounted for substantially linear sliding movement on a support member disposed on the apparatus housing and providing for movement of the bushing along the aforementioned line of action. The bushing may have one or more generally planar bearing surfaces engageable with a generally linear bearing surface or surfaces supported by or formed on the apparatus housing. Specific embodiments are provided wherein the idler scroll support shaft may be journalled in the slide bushing which is slidable in a channel or the shaft may have a hollow bearing bore portion for journalling the slide bushing and the slide bushing, in turn, is slidable on a projection or trunnion formed on the apparatus housing. The support member may be rotatably adjustable to vary the angle formed between the line of action and a line passing through the respective scroll centers or axes of rotation.

The invention provides a unique radial compliance mechanism for co-rotating scroll type fluid handling apparatus and is particularly adapted for a co-rotating scroll compressor. The compliance mechanism eliminates the need for precise scroll orbit radius adjustment at the time of manufacture of the apparatus and is able to compensate for variations in scroll separating forces experienced at different working pressure conditions, minimize the starting torque of a compressor drive motor and relieve stress on the scroll wraps during flooding or slugging with liquid mixed in the working fluid. Those skilled in the art will further appreciate the advantages and superior features of the invention upon reading the detailed description which follows in conjunction with the drawing.

DESCRIPTION OF PREFERRED EMBODIMENTS

Figure 1:
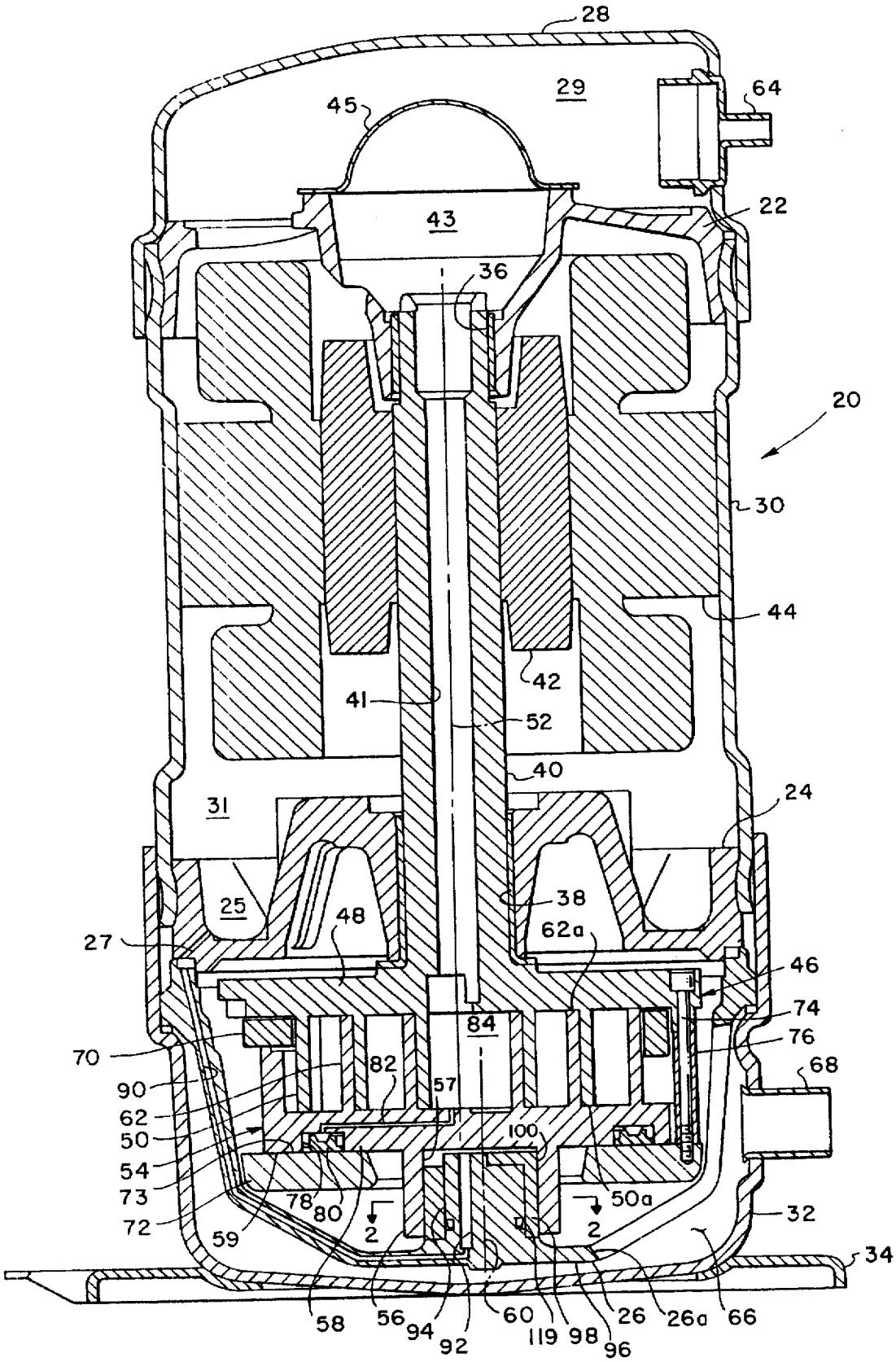
FIG. 1 is a vertical central section view through a motor driven co-rotating scroll refrigeration compressor in accordance with one preferred embodiment of the invention.

In the description which follows, like parts are marked throughout the specification and drawing with the same reference numerals, respectively. The drawing figures are not necessarily to scale in the interest of clarity and conciseness. Certain features which are well known to those of ordinary skill in the art may be shown in somewhat schematic or generalized form, also in the interest of clarity and conciseness.

Referring to FIG. 1, there is illustrated one preferred embodiment of a co-rotating scroll type fluid handling apparatus in accordance with the invention and generally designated by the numeral 20. The apparatus 20 is characterized by an upper, generally cylindrical housing 22, an intermediate housing 24 and a lower housing 26, all disposed within a hermetically sealed, multipart outer shell comprising an upper end cover 28, an intermediate cylindrical shell member 30 and a lower cover member 32 having a suitable support frame 34 connected thereto. The upper housing 22 and the intermediate housing 24 have cylindrical journal bearings 36 and 38 supported thereon, respectively, for supporting a rotatable shaft 40. The shaft 40 is connected to a rotor 42 of an electric drive motor which also includes a stator member 44 of conventional construction. One end of shaft 40 is suitably connected to or formed integral with a driver scroll, generally designated by the numeral 46, having a generally planar transverse end plate 48 and an involute scroll wrap member 50 extending axially therefrom. The shaft 40 and driver scroll 46 are disposed in the bearings 36 and 38 for rotation about a central axis 52.

Figure 2:
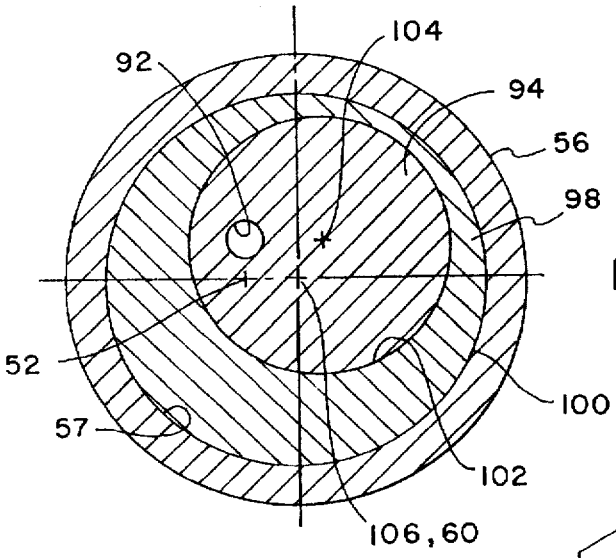
FIG. 2 is a section view taken generally along the line 2—2 of FIG. 1.
Figure 3:
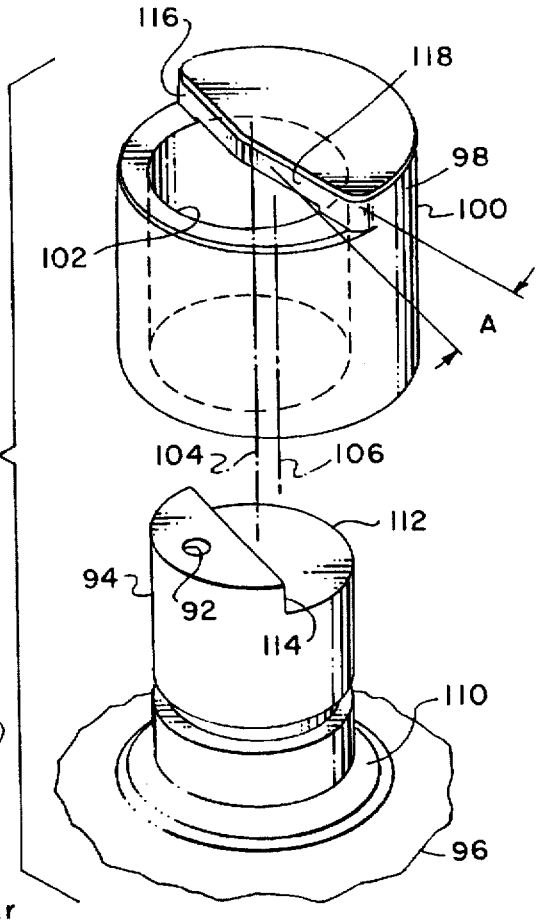
FIG. 3 is an exploded perspective view showing features of the pivot bushing and the supporting stub shaft of the lower housing for the idler scroll support arrangement of the embodiment of FIG. 1.

The driver scroll 46 is drivably connected to an idler scroll member 54 which, in the embodiment shown in FIGS. 1 through 3 includes a hollow cylindrical shaft portion 56 extending from a transverse end plate 58 and having a central axis of rotation 60. The idler scroll 54 includes an axially projecting scroll wrap 62 cooperable with the scroll wrap 50 in a known way to provide plural expansible chambers for compressing refrigerant fluid vapor for discharge through an axial passage 41 formed in the shaft 40. The passage 41 opens into an oil separation chamber 43 which is in communication with a chamber 29 formed between the housings 22 and 24 and for conducting high pressure refrigerant fluid through a suitable high pressure discharge port 64. Low pressure refrigerant vapor is admitted to a chamber 66 formed between the intermediate housing 24 and the cover member 32 by way of a fluid inlet port 68. The housing 26 has suitable ports **26*a* formed therein, one shown, opening to chamber 66**.

Accordingly, refrigerant fluid is admitted to the chamber 66 for entrapment between the scroll wraps 50 and 62 for compression and discharge through the passage 41 in a known way. Passage 41 opens directly into oil separation chamber 43 formed between an upper end of the shaft 40 and a deflector 45 wherein lubricating oil disposed within the compressor shell 28, 30, 32 is separated from the compressed refrigerant gas and is allowed to flow downward to enter the chamber 31. Management of the lubricating oil is carried out in a known way to aid in providing a seal between the co-acting scroll wraps 50 and 62, to lubricate the bearings supporting the scrolls 46 and 54 and to reduce the work of compression on the refrigerant fluid.

The geometry of the scroll wraps 50 and 62 may be of a known type comprising respective involutes or arcs of a circle and preferably comprising about two and one half wraps, for example, about the axes 52 and 60, respectively. The idler scroll 54 is rotatably driven by the driver scroll 46 through an Oldham coupling ring 70 which is engageable with cooperating slots, not shown, formed on the respective scrolls to effect rotation of the idler scroll 54 even though the respective axes of rotation 52 and 60 of the driver scroll and idler scroll are offset, as shown in FIG. 1. Further description of the Oldham coupling 70 is not believed to be necessary to understand the present invention.

The idler scroll 54 is interposed between the end plate 48 of the driver scroll 46 and a generally cylindrical pressure plate member 72 which is supported by the driver scroll 46 for rotation therewith by plural circumferentially spaced threaded fasteners 74 and spacer members 76, one of each shown in FIG. 1, interposed between the end plate 48 and the pressure plate 72. Other means for supporting the idler scroll 54 with respect to the driver scroll 46 may be employed including those described in U.S. Pat. No. 4,927,339 to Riffe et al. and issued May 22, 1990. Reference to this patent may be obtained for discussion and illustration of a typical configuration of the driver and idler scroll geometries also.

The lower transverse face 59 of the end plate 58 includes a circular groove 78 formed therein for supporting a resilient annular seal member 80. Suitable passage means 82 are in communication with one of the scroll compression chambers 84 for communicating pressure fluid to urge the seal member 80 into engagement with a seal surface formed on a face 73 of the pressure plate 72 and to urge the idler scroll 54 axially toward the end plate 48 so that axial sealing is effected at the tips **50*a* and 62*a* of the respective scroll wraps 50 and 62** to minimize fluid leakage from the aforementioned compression chambers.

Still further, pressure lubricating fluid may be communicated from a chamber 31 formed in the shell 30 between the housings 22 and 24 to lubricate bearings supporting the idler scroll shaft 56. Lubricant fluid will collect in a cavity 25 formed by the intermediate housing 24 after separation in the separation chamber 43 and due to the pressure differential between the chambers 29, 31 and chamber 66, will flow under high pressure through a passage 27 in the housing 24 which is in communication with a passage 90 formed in the housing 26. Passage 90 is in communication with a passage 92 formed on an integral stub shaft 94 extending axially upward from a transverse end wall 96 of the lower housing 26, as illustrated in FIG. 1. Pressure lubricant exerts an upward biasing force on the assembly of the driver scroll 46, the driven or idler scroll 54, the pressure plate 72, the shaft 40 and the motor rotor 42. However, an additional biasing force is furnished by pressure fluid flowing through the passage 82 to act in the manner described above to urge the idler scroll 54 axially toward the driver scroll 46.

Referring further to FIGS. 1, 2 and 3, the idler scroll shaft 56 is supported on a unique pivot bushing, generally designated by the numeral 98, which is supported for limited rotation on the stub shaft 94 and forms a bearing for the hollow cylindrical shaft 56. Such bearing is defined by an outer circumferential cylindrical surface 100 of the bushing 98. The bushing 98 is provided with a cylindrical bore 102, FIG. 3, whose center 104 is eccentric with respect to the center axis 106 of the bearing surface 100 and bore 57 of the idler scroll shaft 56. The axis 106 is coincident with the axis 60.

Referring further to FIG. 3, the stub shaft 94 includes a lower transverse bearing surface 110 formed therearound and a stepped distal end 112 forming a transverse diametral stop surface 114. Transverse stop surfaces 116 and 118 are formed on the pivot bushing 98, as shown in FIG. 3. The stop surfaces 116 and 118 are not coplanar and form an acute angle A with respect to each other, as shown in FIG. 3. Accordingly, when the pivot bushing 98 is assembled on the stub shaft 94, pivotal movement of the bushing may occur about the axis 104 as limited by the stop surfaces 116 and 118 engaging the cooperating stop surface 114.

As previously mentioned, pressure lubricant may be introduced through the passage 92 to a chamber formed between the bushing 98 and the portion of end face 59 delimiting the bearing bore 57, to bias the scroll 54 toward the scroll 46 and to flow between the surface 100 and the bore 57 to lubricate the bearing formed thereby for the idler scroll 54. A circumferential lip seal 119, FIG. 1, is disposed on the stub shaft 94, and is operable to limit lubricant flow from the passage 92. The pressure of lubricant acting on the face 59 may be sufficient to urge the entire assembly of the scrolls 54 and 46 upwardly, viewing FIG. 1.

The configuration of the embodiment of the invention described above in conjunction with FIGS. 1 through 3 is derived from the realization that a resultant force is acting between the scroll members 46 and 54, primarily due to gas pressure forces acting on the wraps 50 and 62, tending to move the axis 60 toward the axis 52. This resultant force is indicated by the force vector 122 in FIG. 4, by way of example. The direction of this force vector is substantially unchanged, less than about 10° to 12°, for example, with respect to a line between the axes 52 and 60, over a wide range of operating pressure conditions of a typical vapor-compression refrigeration system compressor, such as the compressor 20. This resultant force 122 comprises a radial gas force **122*r* acting through the axis or center 60 toward the pivot axis 52 and a substantially tangential gas force 122*t* acting in a direction substantially normal to the axis 52 and tangential to the orbit radius 124 of the idler rotation axis 60. Radial compliance or permissible movement of the axes 52 and 60 with respect to each other may be obtained in order to provide for a suitable force exerted to assure sealing contact between the flank surfaces of the scroll wraps 50 and 62, to accommodate separation of the scroll wraps in the event of flow of slugs of liquid trapped in the respective compression chambers and to reduce the requirement for accuracy and positioning of the centers 52 and 60 with respect to each other and the geometry of the scroll wraps in the fabrication of a scroll type apparatus such as the compressor 20**.

Figure 4:
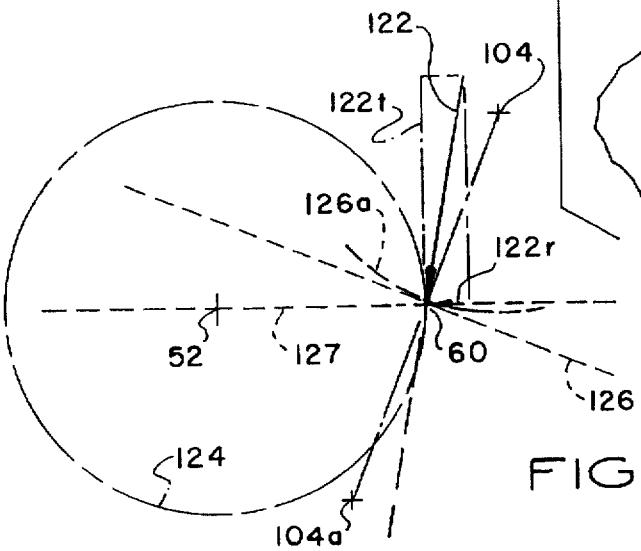
FIG. 4 is a schematic diagram illustrating the location of the line of action with respect to the centers of rotation of the driver scroll and idler scroll of the apparatus illustrated in FIG. 1.

Accordingly, as shown in FIG. 4, a line of action 126 may be chosen which passes through the idler axis of rotation or center 60. The angle chosen for the line 126 with respect to a line 127 extending between the centers 52 and 60, is such as to provide a force component acting on the idler scroll wrap 62 to urge it into sealing contact with the driver scroll wrap 50, in other words, radial movement of the center 60 away from the center 52.

Accordingly, a value for the force vector 122 for the assumed operating conditions of the compressor 20 and the direction of the vector is determined and the line of action 126 then selected to provide a force component acting on the idler scroll 54 such that the scroll will move generally along the line 126 in opposition to the gas forces urging the idler scroll center 60 toward the center 52. This radial movement of the idler scroll center 60 may be obtained by allowing the center 60 to pivot about a pivot point such as the pivot point 104 comprising the pivot axis of the stub shaft journal 94 of the lower housing, or by providing a sliding bearing support for the idler support shaft which can move along the line 126. By selecting the position of the axis 104 to be along a line which passes through the normal or ideal position of the axis or center 60 and is normal to the line 126, the mechanism just described above in conjunction with FIGS. 1 through 3 of the drawing will provide for movement of the center 60 along an arc of a circle **126*a* which is tangent to line 126 at the intersection of line 126 with line 127 at the normal position of center 60. Thus, arc 126*a* has its center at 104. Accordingly, the idler scroll 54 is disposed for limited movement substantially along the line 126 within the limits of movement provided by the cooperating stop surfaces 114, 116 and 118. Such action allows compliant movement of the idler scroll 54 with respect to the driver scroll 46** to maintain adequate sealing contact between the scroll wraps, to accommodate liquid slugs trapped in the scroll compression chambers and to minimize compression chamber volume which is under pressure during compressor startup to thereby reduce motor starting torque and bearing loads during starting.

When the force **122*r* acts to separate the scroll wraps 50 and 62, the center or axis 60 will tend to move toward the center or axis 52. However, the resultant force 122 also creates a moment about the axis 104 tending to rotate the bushing 98 and move the axis 60 of the scroll 54 back to its normal position on the orbit radius 124. Alternatively, the pivot point or axis 104 may be located at 104*a*, FIG. 4, and the force vector 122 may generate a moment tending to move the center 60 in a clockwise direction, viewing FIG. 4, about the axis 104*a*. Accordingly, the radial compliance mechanism described above in conjunction with FIGS. 1 through 3 provides an advantageous manner for providing movement of the idler scroll 54 with respect to the driver scroll 46. For a compressor having co-rotating scrolls of the aforementioned configuration, the acute angle between the lines 126 and 127** may be in a range of about 12° to 18°.

Figure 5:
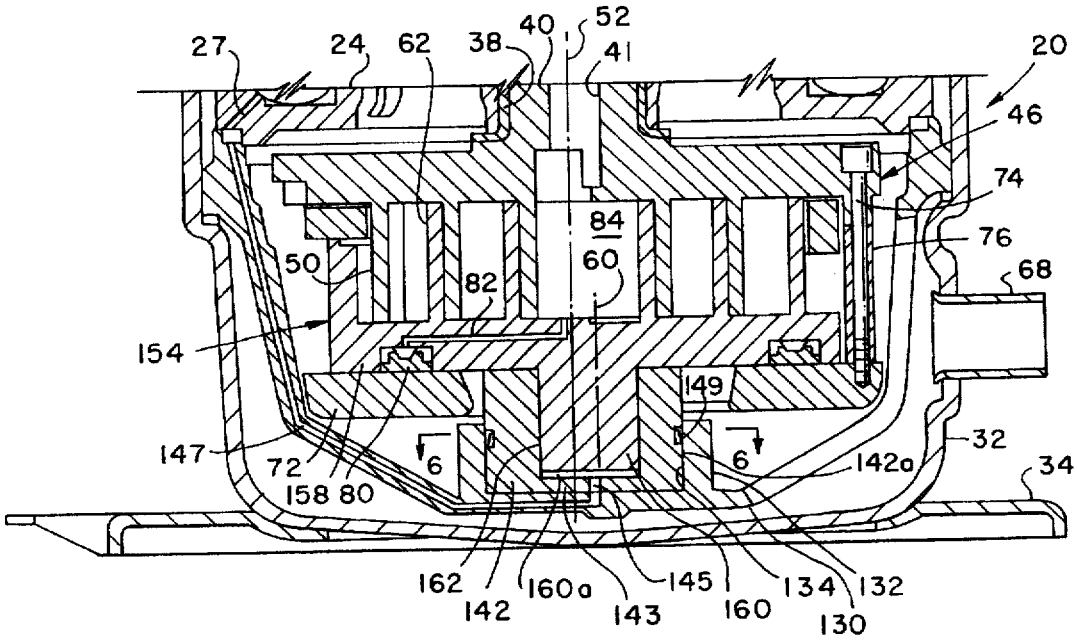
FIG. 5 is a detail section view of the compressor shown in FIG. 1 showing a modification of the pivot support arrangement for the idler scroll.
Figure 6:
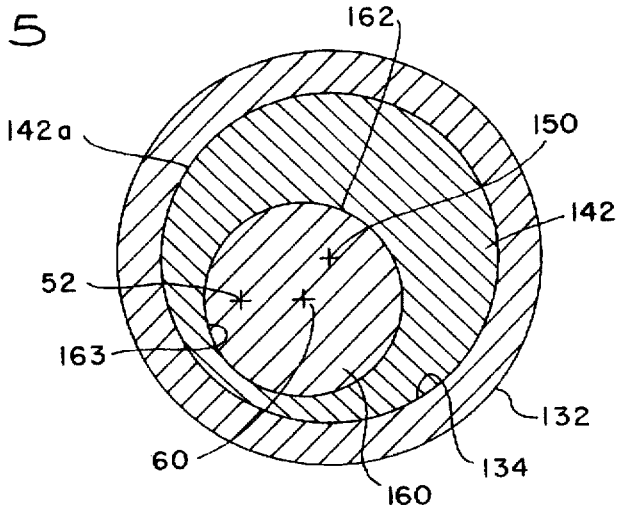
FIG. 6 is a section view taken generally from the line 6—6 of FIG. 5.
Figure 7:
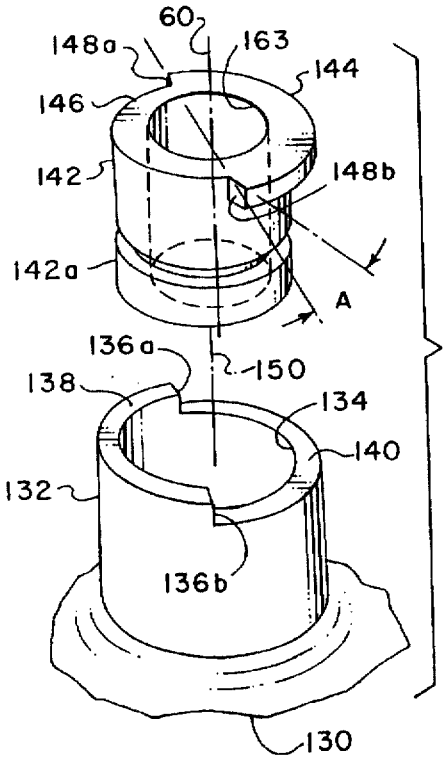
FIG. 7 is a detail exploded perspective view of the pivot bushing of the embodiment of FIG. 5 and showing the modified lower housing support for the pivot bushing.

A modification to the pivot bushing support arrangement for a co-rotating scroll apparatus is illustrated in FIGS. 5, 6 and 7. In the embodiment illustrated in FIGS. 5 through 7, a modified lower housing 130 is provided for the compressor 20 having an upwardly projecting cylindrical integral bearing sleeve 132 formed thereon and defining a bearing bore 134. As shown in FIG. 7, the sleeve 132 is provided with opposed stop surfaces **136*a* and 136*b* formed by relieving the upper transverse edge 138 of the sleeve 132 at 140, as indicated. A cylindrical pivot bushing 142 is adapted to be disposed in the bearing bore 134 and is provided with a semicylindrical collar 144 on an upper distal end 146 having axially and radially extending stop surfaces 148*a* and 148*b* which form an angle with respect to each other, such as the angle A also formed between the surfaces 116 and 118 of the pivot bushing 98. The surfaces 136*a* and 136*b* are coplanar and are cooperable with the pivot bushing 142, when it is disposed in the bore 134, to limit pivotal movement about a central axis 150 of the bore 134, see FIG. 6**.

In the embodiment illustrated in FIGS. 5 through 7, an idler scroll 154, FIG. 5, is provided having an end plate 158 and an axially projecting support shaft 160 having a cylindrical bearing surface 162 whose central axis comprises the idler scroll center or axis of rotation 60. The shaft 160 is operable to be journalled in a bearing formed by a bore 163, FIG. 7, formed in the bushing 142 and having a central axis coincident with the axis 60 and eccentric with respect to the axis 150 of the bushing bearing surface **142*a*. Accordingly, rotation of the bushing 142 in the bearing bore 134 is operable to displace the axis 60 about the axis 150. By replacing the idler scroll 54, bushing 98 and the lower housing 26 with the corresponding parts illustrated in FIGS. 5 through 7, the compressor embodiment illustrated in these figures is otherwise identical to the embodiment illustrated and described in conjunction with FIGS. 1 through 3**.

As shown in FIG. 5, the pivot bushing 142 has a transverse bottom end wall 143 having a central passage 145 formed therein in communication with a lubricant supply passage 147 formed in the housing 130. A lip seal 149 may be disposed on the outer bearing surface **142*a* of the pivot bushing 142, see FIG. 6, also, to limit lubricant flow between the pivot bushing 142 and bore 134 of the bearing sleeve 132. Pressure lubricant introduced through passages 145, 147 acts on the transverse end face 160*a* of the shaft 160 to urge scroll 154 toward scroll 46 and lubricates the bearing formed between surface 162 and bore 163**.

The operation of the embodiment described in conjunction with FIGS. 5, 6 and 7 is substantially like that of the embodiment described in conjunction with FIGS. 1 through 3. A component of a resultant force acting on the idler scroll 154 may cause the pivot bushing 142 to rotate about the axis 150, corresponding to the axis 104, to effect translation of the axis 60 of the idler shaft 162 along a circular arc corresponding to the arc **126*a*, see FIG. 4, to provide radial compliance for the embodiment shown in FIGS. 5 through 7. As a result of liquid being trapped in the scroll compression chambers, for example, the pivot bushing 142 may rotate in the opposite direction to move the axis 60 along the above-mentioned arc toward the axis 52. The stop surfaces 136*a* and 148*a* are cooperable to limit the movement of the idler scroll 154 and its center 60 along the aforementioned arc 126*a* which is tangent to the line 126**.

Figure 8:
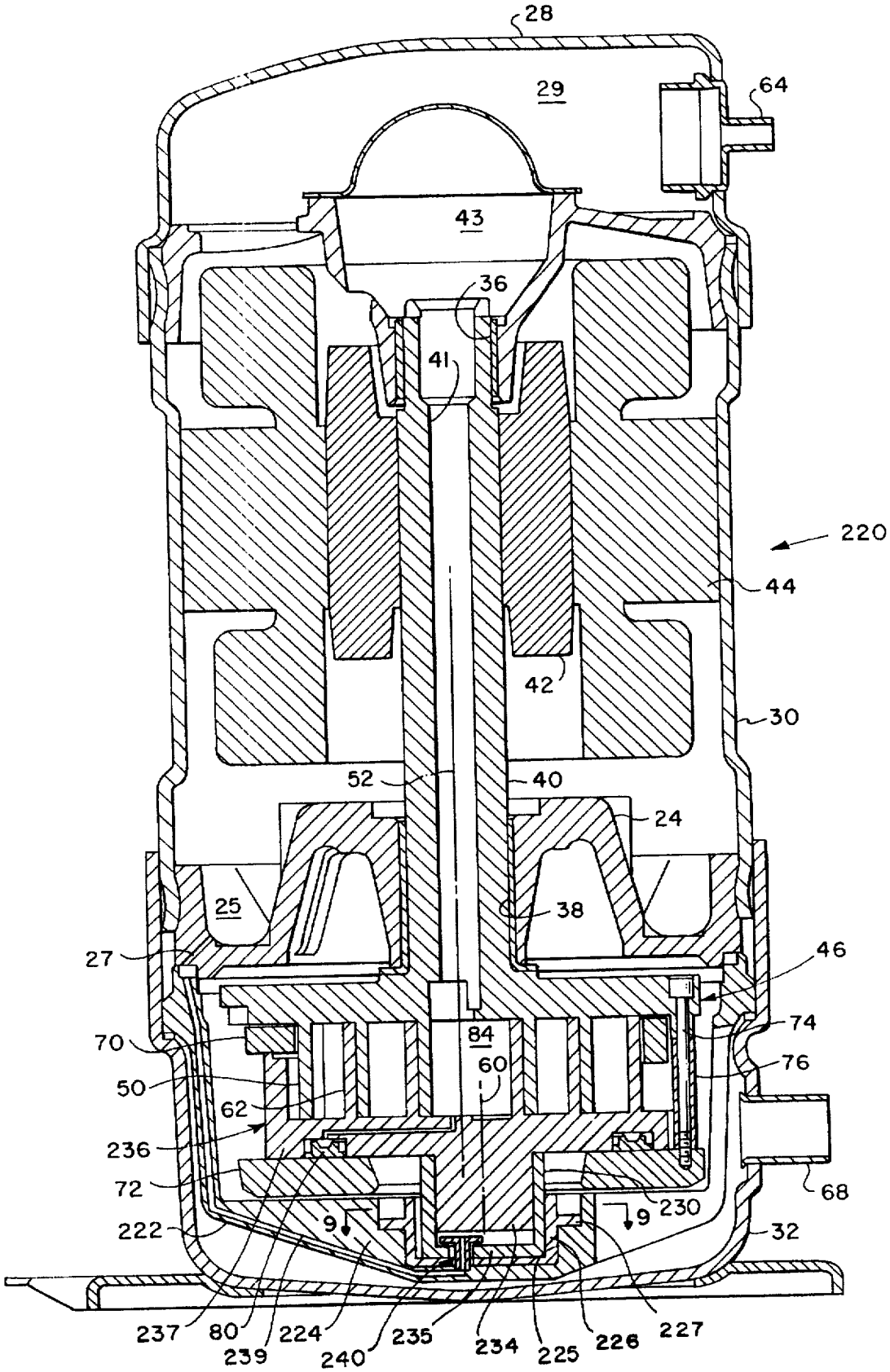
FIG. 8 is a longitudinal central section view of a compressor similar to the compressor shown in FIG. 1 and including another embodiment of a radial compliance mechanism in accordance with the present invention.

Referring now to FIGS. 8 through 12, another embodiment of a radial compliance mechanism for a co-rotational scroll type fluid handling apparatus is illustrated. In the embodiment shown in FIGS. 8 through 12, a compressor 220 is illustrated and includes components similar to the compressor 20 except as indicated hereinbelow. As shown in FIGS. 8 and 9A, the compressor 220 includes a modified lower housing 222 provided with a transverse bottom wall 224 in which is formed a stepped cylindrical bore 225. A generally cylindrical line of action adjuster sleeve 226 is disposed in the bore 225 and includes a radially projecting circumferential flange 227 formed thereon, see FIGS. 11 and 12 also. As shown in FIG. 9A, the sleeve 226 is provided with an elongated channel 228 formed therein and defined by opposed substantially planar sides 228*a* and 228*b* which are operable to be generally parallel to the line of action, such as the line 126 shown in FIG. 2, to allow linear sliding movement of a bushing member 230 therein. The channel 228 is delimited by opposed end walls 229 and 231, FIG. 9A, to limit linear excursion of bushing 230. The sleeve 226 is secured in the stepped bore 225 by suitable threaded fasteners 232, FIGS. 9A, 11 and 12, which are threadedly engageable with the housing bottom wall 224 and project through spaced apart arcuate slots 227*a* formed in the flange 227, as shown in FIG. 9A. Accordingly, the position of the channel 228 formed in the sleeve 226 with respect to housing 222 may be adjusted to effectively adjust the direction of the line of action along which the bushing 230 is operable to move for a purpose to be explained further herein.

The bushing 230 includes a cylindrical bearing bore 233 formed therein for journalling an axially extending cylindrical support shaft part 234 of an idler scroll 236, FIG. 8, having a scroll wrap 62 formed thereon and extending from a transverse end wall 237. The idler scroll 236 is otherwise similar to the idler scroll 54. The shaft part 234 has a center or axis 60 in the same manner as the scroll 54. As shown in FIGS. 8, 9A and 10 through 12, the bushing member 230 has a transverse bottom wall 235 and opposed, generally planar sidewalls 230*a* and 230*b*, FIGS. 9A and 12, which are dimensioned to provide a closely constrained but sliding fit of the bushing 230 in the channel 228. In like manner, the shaft 234 is dimensioned to provide a closely constrained but free rotational fit within the bushing bearing bore 233.

Figure 10:
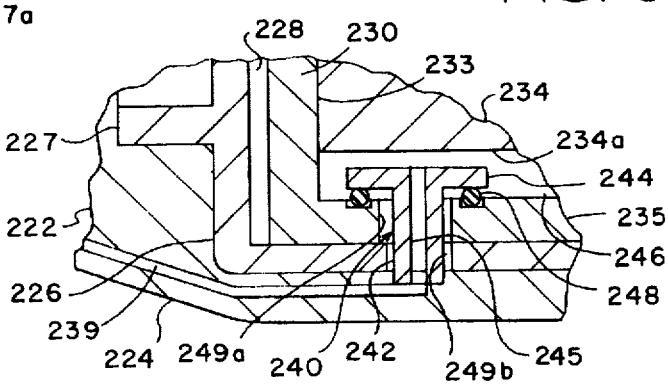
FIG. 10 is a detail section view of the compressor of FIG. 8 showing the arrangement for introducing pressure lubricant into the bearing and support for the idler scroll shaft.
Figure 11:
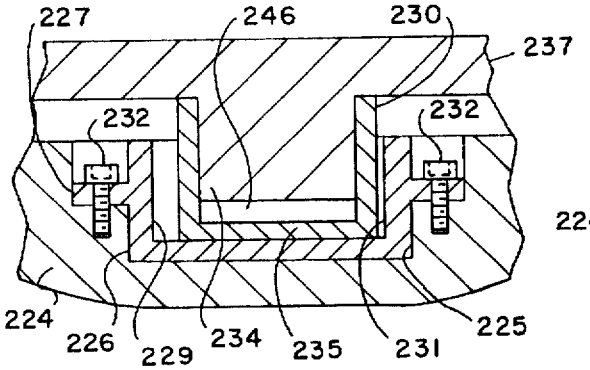
FIG. 11 is a detail section view taken from the line 11—11 of FIG. 9.
Figure 12:
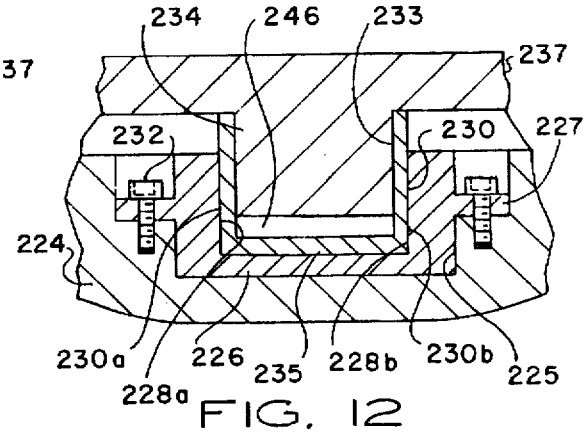
FIG. 12 is a detail section view taken from the line 12—12 of FIG. 9.

Referring now to FIG. 10, lubricating oil is conducted through a suitable passage 239 formed in the housing 222, which passage is in communication with an oil supply fitting 240 comprising a shaft portion 242 secured in a suitable bore formed in the housing bottom wall 224. The opposite end of shaft portion 242 includes a laterally projecting circular flange 244. A central passage 245 extends through the fitting 240 from the passage 239 into a cavity 246 below the transverse end face 234*a* of the shaft 234. A conventional O-ring seal 248 is supported on the bushing bottom wall 235 and is engageable with the flange 244 of the oil supply fitting to prevent leakage of lubricant out of the cavity 246 through the elongated channel 228. The fitting shaft 242 projects through elongated slots 249*a* and 249*b* formed in the bushing bottom wall 235 and the sleeve 226, respectively, to permit movement of these members relative to the fitting 240. Accordingly, lubricating oil may be conducted into the cavity 246 by way of passages 27, 239 and 245 for biasing the scrolls 236 and 46 upwardly, viewing FIG. 8, and for lubricating the bearing surfaces formed on the shaft 234 and the bore 233 and the channel surfaces 228*a* and 228*b*.

Figure 9A:
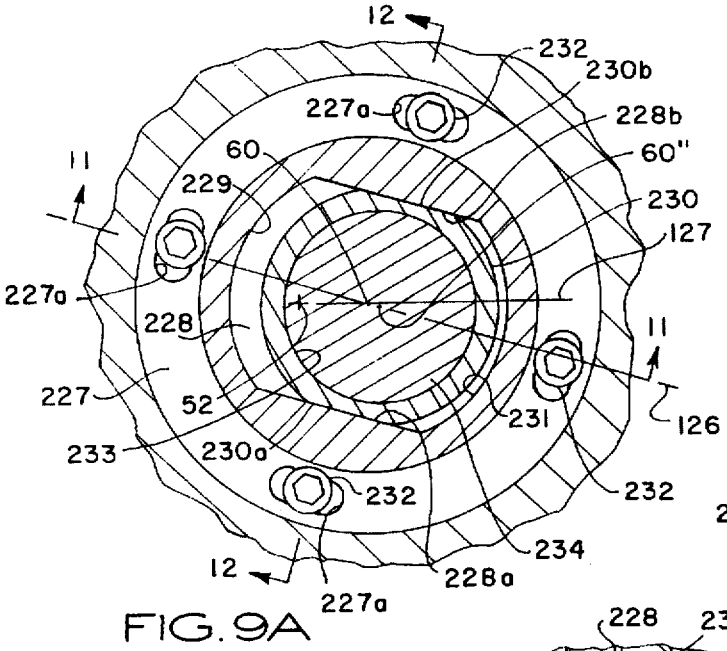
FIG. 9A is a section view taken generally from the line 9—9 of FIG. 8.

In the operation of the compressor 220, the above-mentioned resultant force acting on the idler scroll 236, during most operating conditions, will generate a force component along the line of action 126, FIG. 9A, which will tend to move the scroll center axis 60 along the line as limited by the channel 228 and the shaft bearing support bushing 230. The bushing 230 is free to move in the channel 228 between the opposed end walls 229 and 231 and the locations of these end walls are predetermined to allow the requisite movement of the idler scroll 236 and its shaft 234 together with the bearing bushing 230 within the channel. Accordingly, preselection of the angle between the line of action 126 and a line 127 passing through the idealized location of the axes 52 and 60 will provide a sufficient force component acting on the idler scroll 236 to move the scroll along the line 126 to bias the wraps of the scrolls 46 and 236 into suitable engagement with each other. Moreover, the sleeve 226 may be supported on the housing 222 for selective positioning about the nominal or idealized position of axis 60 to vary the angle of the line of action 126, as desired. In FIG. 9A, the axis of rotation of the shaft part 234 is indicated at 60" for purposes of illustration.

Figure 9B:
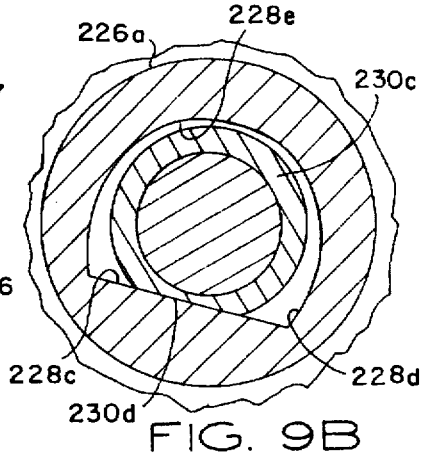
FIG. 9B is a section view taken generally from the same line as FIG. 9A and showing a modified support bushing and linear bearing surface arrangement.

The opposed bearing surfaces 228*a* and 228*b* are provided for practical purposes to adequately journal the scroll 236 against unwanted movement during operation, shipping and other handling, for example. However, only one bearing surface is actually required to position the idler scroll for movement along the line of action 126. Referring to FIG. 9B, for example, a modified support bushing 230*c* is provided with a single, generally planar, bearing surface 230*d* cooperable with a planar bearing surface 228*c* formed in a channel 228*d* which has an arcuate surface 228*e* forming clearance for the bushing 230*c*. The channel 228*d* is formed in a modified sleeve 226*a*, which sleeve is otherwise configured similar to the sleeve 226.

Referring now to FIGS. 13, 14A, 15 and 16, a modified idler scroll and lower housing arrangement for the compressor 220 is illustrated wherein the scroll 236 is replaced by a scroll 250 having a transverse end wall 251 and a generally cylindrical tubular shaft portion 252 extending therefrom and rotatable about an axis which coincides with central axis 60. The lower housing 222 is replaced by a housing 254 having a transverse bottom wall 256 with an upstanding, generally elongated trunnion 258, preferably having opposed generally planar bearing surfaces 260 and 262 and opposed end walls 264 and 266, see FIG. 14A. An intermediate bushing member 268 is interposed between the shaft 252 and the trunnion 258 and has an elongated slot 270 formed therein, preferably having opposed, generally planar sidewalls 272 and 274 and opposed end walls 276 and 278, FIGS. 14A, 15 and 16. The spacing of the end walls 276 and 278 is greater than the spacing between the end walls 264 and 266 of the trunnion 258 to allow sliding movement of the bushing 268 on the trunnion along the line 126, FIG. 14A. The bushing 258 has a generally cylindrical outer bearing diameter 280 which is operable to be disposed in a bearing bore 253 of shaft 252 to support the shaft 252 for rotation thereon.

Figure 13:
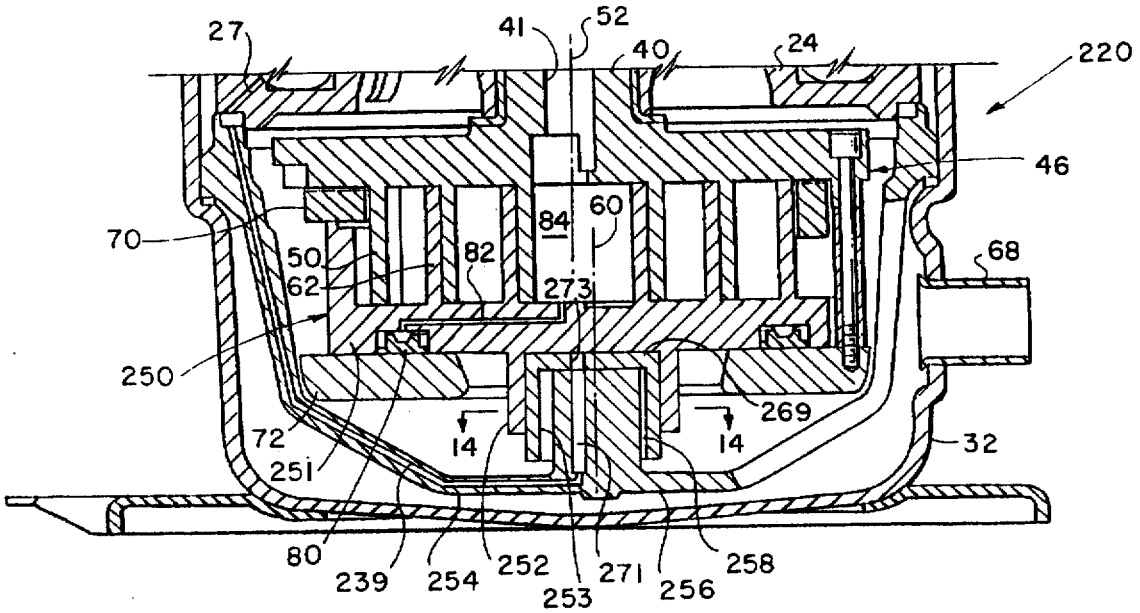
FIG. 13 is a detail section view of a lower portion of the compressor embodiment shown in FIG. 8 showing a modification to the idler scroll support shaft and support bearing arrangement.

The transverse bottom wall 256 of the lower housing 254 has a suitable lubricant supply passage 239 therein for introducing bearing lubricant through a passage 271 in the trunnion 258 and a passage 273 formed in a transverse end wall 269 of the bushing 268 to lubricate the bearing surfaces between the shaft 252 and the bushing 268, the cooperable bearing surfaces of the trunnion and the bushing and to urge the scrolls 250 and 46 upwardly, viewing FIG. 13. Some lubricant will flow onto the surfaces formed, between the bushing 268 and the trunnion 258 to allow free sliding movement of the bushing on the trunnion Accordingly, the modified idler scroll 250 and modified lower housing 254 illustrated in FIGS. 13, 14A, 15 and 16 may be substituted for the scroll 236 and housing 222 in the compressor 220 while allowing the compressor to enjoy the same radial compliance motion between the idler scroll 250 and the driver scroll 46 as is obtained with the other embodiments of the scroll type fluid handling apparatus described herein.

Figure 14A:
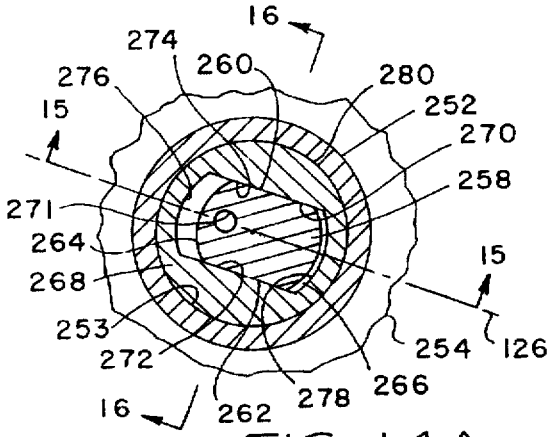
FIG. 14A is a section view taken from the line 14—14 of FIG. 13.
Figure 14B:
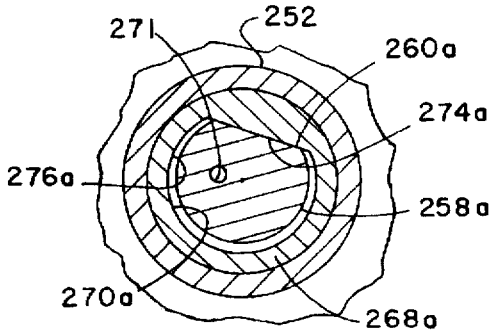
FIG. 14B is a section view taken generally from the same line as FIG. 14A and showing a modified support bushing and trunnion arrangement.
Figure 15:
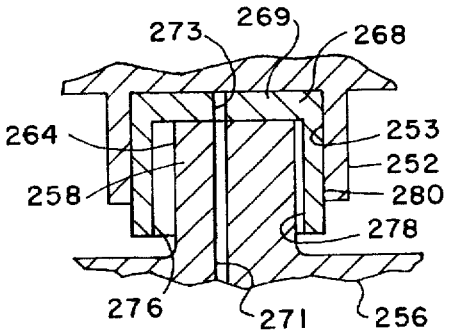
FIG. 15 is a detail section view taken from the line 15—15 of FIG. 14.
Figure 16:
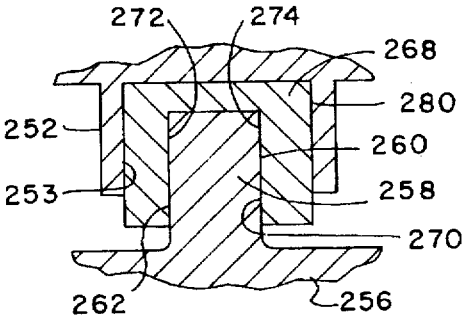
FIG. 16 is a detail section view taken from the line 16—16 of FIG. 14.

The embodiment of the radial compliance mechanism illustrated in FIGS. 13, 14A, 15 and 16 may be modified somewhat in accordance with the arrangement of FIG. 14B. As with the embodiment described in conjunction with FIGS. 8 through 12, only one planar bearing surface may be required for providing radial movement of the scroll 250 with respect to the scroll 46. For example, a trunnion 258*a* may be formed having a single planar bearing surface 260*a* cooperable with a bearing surface 274*a* formed in a slot 270*a* in a bushing 268*a*. The bushing 268*a* has an arcuate surface 276*a* delimiting the slot 270*a*. The bushing 268*a* is operable to support the shaft portion 252 of scroll 250 thereon in the same manner as the arrangement shown in FIG. 14A. The bearing surfaces 260*a* and 274*a* extend in a plane parallel to the line of action 126.

The embodiments of the apparatus of the invention described and shown in FIGS. 1 through 16 may be constructed using conventional engineering materials for scroll type fluid handling apparatus including compressors, expanders and vacuum pumps. Although the embodiments of the invention described are particularly adapted for operation as compressors in vapor compression refrigeration systems and may utilize conventional engineering materials and methods of manufacture known to those of skill in the art of such compressors, the features of the invention described herein may be incorporated into other types of scroll fluid handling apparatus. Moreover, although preferred embodiments of the invention have been described in detail herein, those skilled in the art will recognize that various substitutions and modifications may be made to the particular embodiments described without departing from the scope and spirit of the invention as set forth in the appended claims.

What is claimed is:

1. A scroll fluid handling apparatus comprising:

housing means;

a first scroll member supported on said housing means for rotation with respect to said housing means about a first axis, said first scroll member having an axially extending spiroidal scroll wrap disposed thereon;

a second scroll member disposed on said housing means and having a shaft portion disposed on a support for rotation about a second axis spaced from and substantially parallel to said first axis, said second scroll member having an axially extending spiroidal scroll wrap interfitted with said scroll wrap of said first scroll member to define at least one variable volume chamber delimited by said scroll wraps, said shaft portion of said second scroll member being disposed on said support for movement substantially along a line of action forming an angle with respect to a line extending between said first axis and said second axis, in response to a pressure fluid force acting on said second scroll member;

said support including means forming a channel;

a bearing bushing disposed in said channel for linear movement therealong and forming a bearing for supporting said shaft portion of said second scroll member; and a lubricant supply fitting extending through a wall of said bearing bushing and operable to be in communication with a lubricant supply passage in said housing means for conducting lubricant to a chamber interposed between said bearing bushing and a transverse end wall of said shaft portion of said second scroll member, said fitting providing for communication of lubricant from said supply passage to said chamber regardless of the position of said bearing bushing in said channel.

2. The scroll apparatus set forth in claim 1 wherein:

said line of action forms an angle of between 12° to 18° with respect to said line extending between said first and second axes.

3. The scroll apparatus set forth in claim 1 wherein:

said housing means includes sleeve means supported thereon for limited movement to a selected position of said line of action, said sleeve means including means engageable with bearing means for said shaft portion.

4. The scroll apparatus set forth in claim 1 wherein:

said channel is defined by at least one, generally planar bearing surfaces extending substantially parallel to said line of action and said bearing bushing includes cooperating surface means engageable with said at least one surface defining said channel to provide free sliding movement of said bearing bushing in said channel and along said line of action.

5. The scroll apparatus set forth in claim 1 wherein:

said channel is defined by opposed, generally planar surfaces extending substantially parallel to said line of action and said bearing bushing includes cooperating surfaces engageable with said surfaces defining said channel to provide constrained but free sliding movement of said bearing bushing in said channel and along said line of action.

6. A scroll fluid handling apparatus comprising:

housing means including a trunnion part extending therefrom;

a first scroll member supported on said housing means for rotation with respect to said housing means about a first axis, said first scroll member having an axially extending spiroidal scroll wrap disposed thereon;

a second scroll member disposed on said housing means and having a shaft portion supported for rotation about a second axis spaced from and substantially parallel to said first axis, said second scroll member having an axially extending spiroidal scroll wrap interfitted with said scroll wrap of said first scroll member to define at least one variable volume chamber delimited by said scroll wraps, said shaft portion of said second scroll member being disposed for linear movement substantially along a line of action forming an angle with respect to a line extending between said first axis and said second axis, in response to a pressure fluid force acting on said second scroll member; and a bearing bushing disposed on said trunnion part and slidable therealong along said line of action, said bearing bushing including a bearing surface engaged with a cooperating surface on said shaft portion of said second scroll member for supporting said second scroll member for said linear movement.

7. A scroll compressor comprising:

housing means;

a first scroll member supported on said housing means for rotation with respect to said housing means about a first axis, said first scroll member having an axially extending scroll wrap formed thereon;

a second scroll member disposed on said housing means and having an axially extending scroll wrap interfitted with said scroll wrap of said first scroll member to define at least one variable volume chamber delimited by said scroll wraps, said second scroll member including a shaft portion adapted for rotation with respect to said housing means;

coupling means interconnecting said first scroll member and said second scroll member and providing for rotation of said second scroll member with said first scroll member; and a support for supporting said shaft portion of said second scroll member for rotation about a second axis spaced from and substantially parallel to said first axis, said support including a bearing bushing engaged with said shaft portion and means for supporting said bearing bushing for linear movement of said shaft portion including a sleeve defining a channel and supported on said housing means for limited rotation to a selected position of said channel.

8. The scroll compressor set forth in claim 7 wherein:

said channel is defined by at least one substantially planar surface and said bearing bushing includes a cooperating bearing surface engageable with said surface defining said channel to provide sliding movement of said bearing bushing in said channel to effect movement of said shaft portion and said second scroll member relative to said first scroll member.

9. A scroll compressor comprising:

housing means;

a first scroll member supported on said housing means for rotation with respect to said housing means about a first axis, said first scroll member having an axially extending scroll wrap formed thereon;

a second scroll member disposed on said housing means and having an axially extending scroll wrap interfitted with said scroll wrap of said first scroll member to define at least one variable volume chamber delimited by said scroll wraps, said second scroll member including a shaft portion adapted for rotation with respect to said housing means;

coupling means interconnecting said first scroll member and said second scroll member and providing for rotation of said second scroll member with said first scroll member; and a support for supporting said shaft portion of said second scroll member for rotation about a second axis spaced from and substantially parallel to said first axis, said support including a bearing bushing engaged with said shaft portion and means for supporting said bearing bushing for linear movement said shaft portion including a trunnion part extending from said housing means, said bearing bushing being disposed on said trunnion part and engageable therewith along cooperating, generally planar bearing surfaces on said bearing bushing and said trunnion part, said bearing bushing forming a bearing surface for supporting said shaft portion whereby said second scroll member is movable relative to said trunnion part and said first scroll member.

10. A scroll fluid handling apparatus comprising:

housing means including a trunnion part extending therefrom;

a first scroll member supported on said housing means for rotation with respect to said housing means about a first axis, said first scroll member having an axially extending spiroidal scroll wrap disposed thereon;

a second scroll member disposed on said housing means and having a shaft portion supported for rotation about a second axis spaced from and substantially parallel to said first axis, said second scroll member having an axially extending spiroidal scroll wrap interfitted with said scroll wrap of said first scroll member to define at least one variable volume chamber delimited by said scroll wraps, said shaft portion of said second scroll member being disposed for linear movement substantially along a line of action forming an angle with respect to a line extending between said first axis and said second axis in response to a pressure fluid force acting on said second scroll member; and a bearing bushing disposed on said trunnion part and slidable therealong along said line of action, said bearing bushing forming a bearing surface for supporting said shaft portion of said second scroll member, said bearing bushing and said trunnion part including cooperating, generally planar bearing surfaces for supporting said bearing bushing for limited generally linear movement of said second scroll member relative to said housing means.

* * * * *